US005378529A

United States Patent [19]

Bourdeau

[11] Patent Number: 5,378,529

[45] Date of Patent: Jan. 3, 1995

[54] MATERIAL ALLOWING THE ABSORPTION AND DRAINAGE OF MOISTURE AND ARTICLE OF CLOTHING FITTED WITH A MATERIAL OF THIS KIND

[75] Inventor: Jöel Bourdeau, Saint Jorioz, France

[73] Assignee: Salomon S.A., Chavanod, France

[21] Appl. No.: 761,778

[22] PCT Filed: Jan. 14, 1991

[86] PCT No.: PCT/FR91/00021

§ 371 Date: Sep. 24, 1991

§ 102(e) Date: Sep. 24, 1991

[87] PCT Pub. No.: WO91/11122

PCT Pub. Date: Aug. 8, 1991

[30] Foreign Application Priority Data

Jan. 24, 1990 [FR] France ..... 90 00784

[51] Int. Cl.[6] ..... D03D 3/00; D03D 15/00; B32B 5/06

[52] U.S. Cl. ..... 428/224; 428/36.1; 428/36.2; 428/225; 428/226; 428/232; 428/233; 428/284; 428/294; 2/159; 2/162; 2/163

[58] Field of Search ..... 428/36.1, 36.2, 36.3, 428/36.9, 36.91, 224, 225, 226, 232, 233, 282, 294

[56] References Cited

U.S. PATENT DOCUMENTS 4,283,454 8/1981 Buchanan ..... 428/233
4,775,575 10/1988 Tang ..... 428/233

*Primary Examiner*—George F. Lesmes
*Assistant Examiner*—Kathryne E. Shelborne
*Attorney, Agent, or Firm*—Pollock, Vande Sande & Priddy

[57] ABSTRACT

A multilayered material for clothing adapted to transfer moisture from the skin of the user, includes a waterproof top layer, a bottom layer constituting a lining and comprising moisture collectors extending radially between the top and bottom layers, and longitudinal drains which carry the moisture away from its source. The material can be used for gloves, sports shoes as well as garments.

21 Claims, 2 Drawing Sheets

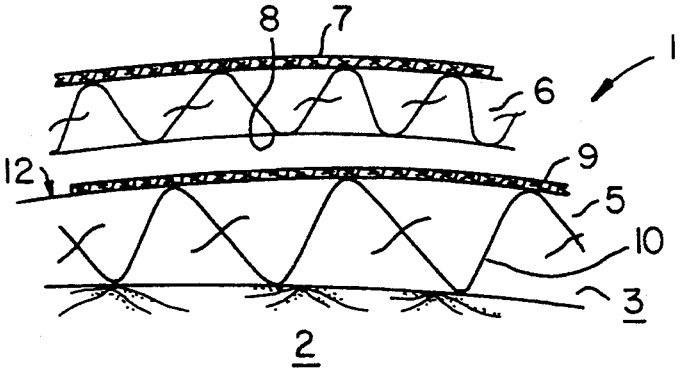
FIG. 1
FIG. 2
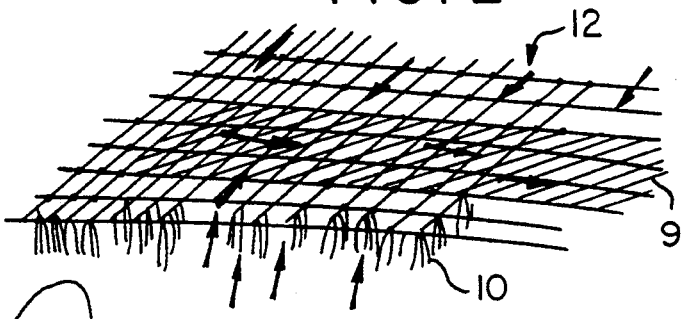
FIG. 3
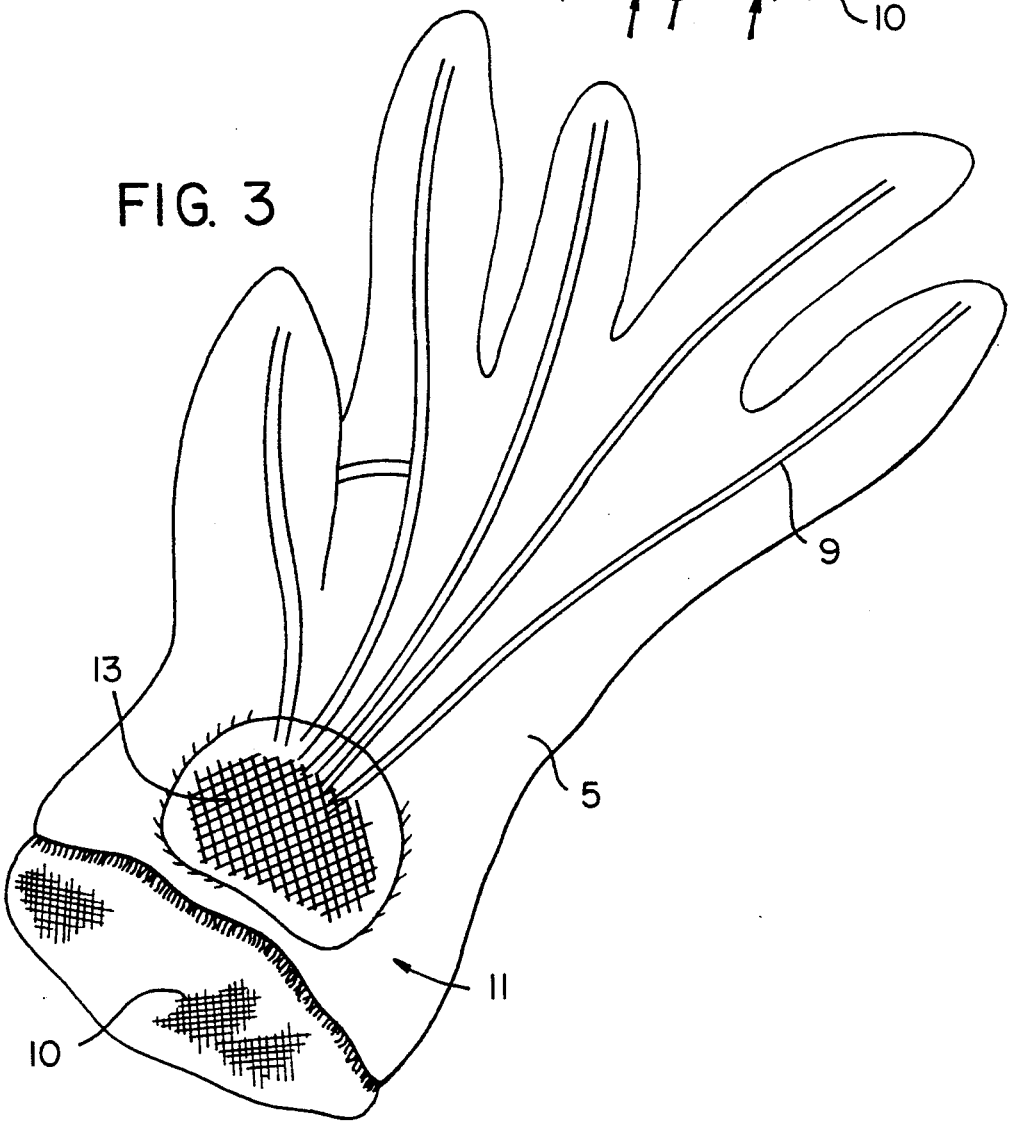

MATERIAL ALLOWING THE ABSORPTION AND DRAINAGE OF MOISTURE AND ARTICLE OF CLOTHING FITTED WITH A MATERIAL OF THIS KIND

FIELD OF THE INVENTION

The present invention concerns a material allowing the absorption and drainage of moisture, in particular of perspiration.

BACKGROUND OF THE INVENTION

It is known that the skin of an individual continuously breathes and perspires, perspiration becoming more abundant as body activity and its temperature increase, especially during and following activity.

When skin is naked, sweat resulting from this perspiration is vaporized into the ambient air, thereby promoting cooling of the skin surface and thermal regulation of the body.

When the skin is covered, for example with an article of clothing, vaporization of sweat, as well as the corresponding heat exchange, occurs only to a limited extent. The skin becomes moist, the moisture is more or less absorbed by the material covering the skin, and this material becomes wet to a corresponding degree, thereby causing well-known, disagreeable sensations.

This discomfort becomes especially pronounced when the material covering the skin is moisture-proof and in particular moisture-proof to water-proof, since the moisture thus produced cannot be channelled away to the outside and remains in contact with the skin, thus producing an uncomfortable feeling.

Furthermore, in the case of an article of clothing designed to protect against cold, the undrained moisture thus produced conducts cold and is a factor leading to cooling of the skin.

In-the case of sports clothing which both insulates and provides moisture-proofing, since it is subjected to marked variations of temperature between the outer surface and the skin which vary over time as a function of the activity of the individual, the moisture-proofing can increase still further, and in pronounced fashion, the feeling of discomfort.

In fact, perspiration, composed mainly of water, is a good conductor of heat. In the event of insufficient thermal insulation, the sweat thus cools very rapidly and condenses, a phenomenon which exacerbates the feeling of discomfort. Moreover, a "soaked" insulator loses the major portion of its thermal insulation qualities.

SUMMARY OF THE INVENTION

It is an object of the invention to propose a material designed to produce clothing which is moisture-proof to external moisture and which is potentially thermally insulating, and which absorbs and removes the moisture from perspiration so as to improve the feeling of comfort for the individual on whose it is worn, and to preserve the insulating properties of the insulating material in the case of a thermally-insulating article of clothing. The term "clothing" signifies anything which covers the human body in order to protect it, and in particular any article of clothing such as socks or shoes designed to be in contact with the skin.

The invention comprises a multi-layered material which allows moisture transfer and which comprises in succession, beginning at the surface exposed to the moisture, a lining and an outer moisture-proof covering, and, between the lining and the outer covering, means for the longitudinal transfer of moisture. The lining comprises a plurality of moisture collectors which are connected to the transfer means and which pass through the lining until they come into proximity with the surface subjected to the moisture.

In this way, the moisture is collected by the collectors at the surface exposed to moisture and is transferred by these collectors to the longitudinal transfer means. Accordingly, the moisture is removed from the skin and is thus no longer in contact with it, thereby eliminating the feeling of discomfort associated with such contact.

The transfer means are drains which collect and conduct the moisture, and which are connected to at least one moisture-storage capacity, thus making it possible to totally remove the moisture from the skin. The drains are preferably formed from threads, wicks, or strips of a hydrophilic material so as to better conduct the moisture, and are preferably numerous and small, so as to be better distributed over the moist surface and to better initiate drainage.

According to a preferred embodiment of the invention the storage capacity is formed from an absorbent material, this material being an irreversible absorbent, and the capacity is removable so as to allow the material to be changed, in which case a visual indicator of moisture load can be provided; or the material is a reversible absorbent capable of releasing the absorbed water, by a drying process or other means. In this case, the lining can be detached from the outer covering, so as to facilitate drying. It can also be removable.

Advantageously, the storage capacity is located at a distance from the area of moisture production, so as to avoid leakage of the moisture stored as a result of excessive pressure.

The material according to the invention may also incorporate a layer of insulating material between the lining and the moisture-proof outer covering; in this case, the layer of insulating material is fitted with an internal moisture-proof covering so as to prevent the collected moisture from penetrating into the insulating material, a phenomenon which would markedly reduce the thermal insulation capabilities of the material.

Finally, the lining is preferably made of a material which incorporates a multitude of threads (or hairs) forming the collectors which collect the water and conduct it by capillarity to the drains.

The material according to the invention is particularly well suited to the manufacture of moisture-proof clothing, such as rubber gloves for work in damaging environments or environments which must be preserved, as well as to the manufacture of sports clothing, and, in particular, clothing exposed to rigorous atmospheric conditions and which must exhibit simultaneously the properties of moisture-proofing and thermal insulation. This is the case, for example, of gloves, especially alpine ski gloves, sports and leisure clothing, and, for example, ski, hiking, or climbing apparel.

The following description is based on the manufacture, using the material according to the invention, of an alpine ski glove which is both thermally insulating and moisture-proof; but the invention is not limited to an embodiment of this kind.

In order that the invention may be more clearly understood, it will now be described with reference to the attached drawings, in which:

FIG. 1 is a transverse cross-section views of the material according to the invention;

FIG. 2 is a diagram of the working principle;

FIG. 3 is a schematic perspective view of a lining fitted with the moisture-transfer mechanism according to the invention.

DESCRIPTION OF PREFERRED EMBODIMENTS

Figure 4:
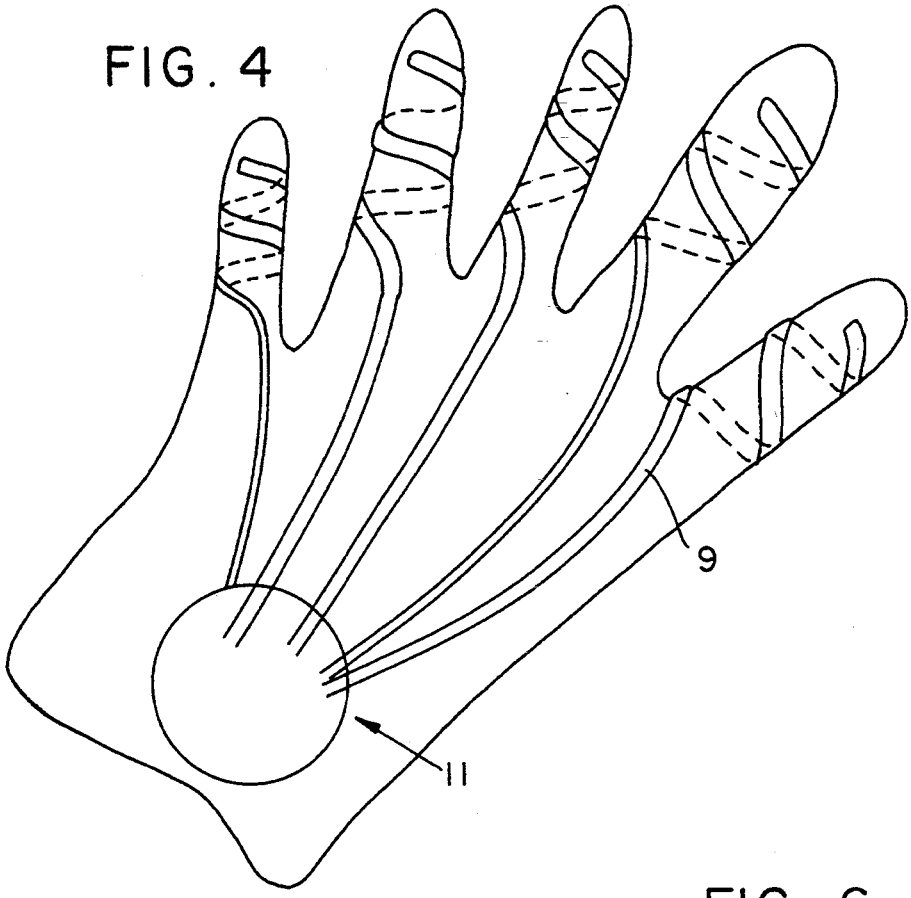
FIGS. 4, 5, and 6 are views similar to FIG. 3 illustrating three variants.

FIG. 1 illustrates an example of the material 1 according to the invention in contact with the skin 2 of an individual. The side turned toward the skin is called the inner side 3; the other, turned toward the outside, is called the outer side 4. The material incorporates a series of substantially parallel layers including, from interior to exterior, a lining 5, a thermal insulator 6, and an outer covering 7.

According to a complementary arrangement, the insulator is covered, on its inner side, with a moisture-proof inner covering 8 which prevents any transfer of moisture through the insulating material.

The material comprises, between the insulator 6 and the lining 5, moisture-transfer means 9 whose function is to transfer the moisture present on the inner side 3 and collected by the collectors, in order to channel it away. According to an advantageous arrangement, moisture transfer occurs parallel to the layers of material, i.e., in a substantially longitudinal direction in relation to the skin 2 of the individual, while collection of the moisture on the skin using the collectors 10 occurs in a substantially radial direction, i.e., perpendicular to the skin.

The longitudinal transfer means preferably comprise moisture-collection drains 9.

The lining 5 comprises a plurality of moisture collectors 10 connected to the drains 9 and which extend through the lining to the inner surface 3, so as to be in contact with the skin 2 and thus, with the moisture.

The drains 9 themselves are connected to a storage capacity designed to absorb the collected water, or sweat.

The drains 9 are formed from strips made of a hydrophilic material, threads, or wicks. These drains are in close contact with the outer surface 12 of the lining, in order to present a maximum surface area in contact with the ends of the collectors 10.

The drains 9 are preferably numerous and short, so as to be better distributed over the moist surface and to become rapidly saturated.

The storage capacity 11 is, in the embodiment illustrated, formed by a pocket 13 containing a conventionally-known absorbent, or hyper-absorbent, material, such as reticulated polyacrylates.

In a first embodiment, the material is an irreversible absorbent and the pocket 13 is detachable. When saturated with water, it can be removed and replaced with a new dry pocket. In order to easily determine the degree of water saturation, the pocket may comprise a visual indicator of moisture load. The conventional indicator may function by color change or modification of consistency.

In a second embodiment, the absorbent material is reversible. It can be dried and used many times. The lining is, in this case, mounted in the glove so as to be detachable, thus accelerating drying. This lining 5 may also be only partially detachable. Localization of water in a very specific area of the article of clothing makes it possible to detach the lining only partially from the outer covering. Conventional windows, sleeves that can be turned inside out, or zipper openings means can be provided for this purpose.

The storage capacity 11 is preferably installed at in a spot in the clothing which is at a distance from the moisture-production zone. This arrangement is important, particularly when the production zone is subjected to abrupt pressure variations. Were these pressures to be transmitted to the hyper-absorbent material, they would force the water out of the storage volume, or they could place the skin back in contact with the moisture.

The lining 5 is made from a material composed of woven or knitted fibers having, on the outer side 4, a mesh network to which the drains 9 are attached; and, on the inner side 3 designed to be in contact with the skin, a multitude of fibers, or collectors 10.

The fibers making up the lining 5 and the collectors 10 are hydrophobic so as not to absorb water and thus to avoid any desorption under pressure against the skin (during activity) which would once again dampen the skin.

The fibers 10 become wet in contact with the skin and conduct the water by capillarity to the outer mesh-work surface 4 of the lining 5 and to the drains 9.

These fibers are preferably made of a synthetic material and may be woven or appear as a fur, condensation forming on the hairs (collectors) at their coldest base, i.e., away from the skin, this condensation thus not producing any disagreeable sensation. It will be noted that water collection by means of capillarity is extremely advantageous, since it does not require moistening of the heart of the fiber and thus makes possible a comfortable contact between the fibers and the skin itself during the collection phase.

The material functions in the following manner:

In a first phase, the material is dry and the skin begins to perspire. Sweating begins and the sweat reaches the collectors 10. Through capillarity, the water is transported and passes through the entire thickness of the lining 5 until it reaches the drains 9, the material composing the drains 9 being hydrophilic, and these drains absorb the water. When the collection zone, i.e., the entire length of the drain 9, becomes saturated, the water comes into contact with the absorbent material arranged in the storage capacity. Drainage is thus initiated at a distance from the skin, and thus without discomfort felt on the skin, and it continues until an equilibrium (osmotic) between the drains and the storage capacity is obtained.

According to the invention, the insulator 6 comprises an moisture-proof inner layer in order to prevent the collected moisture from penetrating into the insulator and damaging the thermal insulation properties of the insulator. However, according to the invention, the outer surface 7 of the insulator, i.e., the external surface of the article of clothing, remains continuously dry, since it is protected from moisture on both sides, and its properties are retained. In this case, the moisture caused by perspiration is more abundant, since there is no longer any exchange with the outside because of moisture-proofing, but this moisture is absorbed by the moisture-transfer mechanism and the lining ultimately possesses a minimal level of moisture, and the contact of the skin with the lining remains comfortable.

The invention may be used for any kind of moisture-proof clothing, including sport footwear, and in particular ski boots It can also be applied to water-proof clothing which does not, however, require any particular thermal insulation. It can also be applied to other water-proof fabrics designed to be in contact with the skin for long periods of time, this is the case of e.g. seats, and especially car seats.

The drains may have other configurations, for example, as shown in FIG. 4, according to which shows the drains arranged in spirals on the fingers.

Figure 5:
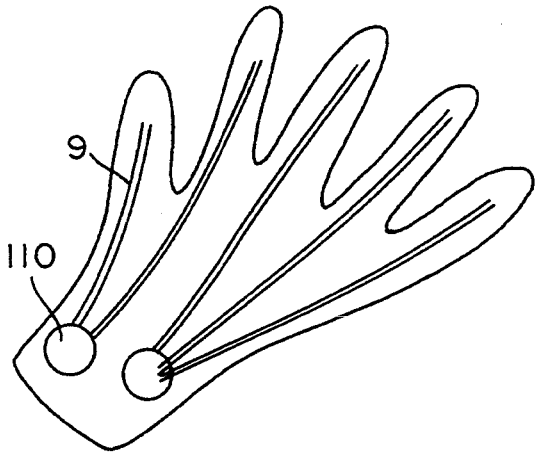
Figure 6:
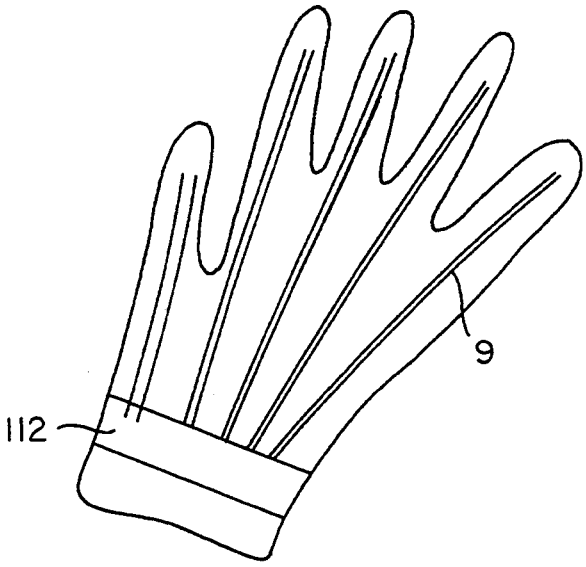

As shown in FIG. 5, moisture storage may be accomplished using several elements 110, 111 or around the periphery 112, for example around the wrist, as illustrated in FIG. 6. It should thus be indicated that moisture storage may be accomplished in a pocket formed from a microporous membrane containing salts.

Finally, according to one feature of the invention, the collectors have an absorptive capacity that is less than that of the drains, which themselves have an absorptive capacity that is, in turn, less than that of the storage component.

I claim:

1. Clothing made of a multilayered moisture transfer material comprising:

(a) a top layer of waterproof material forming a waterproof outer covering (7) turned toward an outside of said clothing and defining an outer surface (4);

(b) a bottom layer forming a lining (5) turned toward an inner side of said clothing and defining an inner surface (3);

(c) said lining comprising a plurality of moisture collectors (10) extending substantially radially of said top and bottom layers, said moisture collectors (10) extending through said lining (5) from said inner surface (3), so as to contact with the moisture, to longitudinal moisture transfer means (9) arranged between said lining (5) and said outer covering (7);

(d) said moisture collectors being disposed substantially longitudinally of said top and bottom layers in order to transfer said moisture parallel to said layers of material wherein the moisture collectors are formed by threads comprising a water-repellent material and extending at least partially in a radial direction within said lining, beginning at the surface in contact with the moisture.

2. Clothing according to claim 1, wherein moisture collection is achieved by capillarity.

3. Clothing according to claim 1, wherein said moisture-transfer means are constituted by moisture-conductive collection drains.

4. Clothing according to claim 2, wherein said drains are formed by strips, threads, or wicks made of hydrophilic material.

5. Clothing according to claim 4, wherein each said drain is relatively short.

6. Clothing according to claim 1, wherein said moisture-transfer means are connected to at least one moisture-storage capacity (11).

7. Clothing according to claim 6, wherein said storage capacity (11) comprises an absorbent material (13).

8. Clothing according to claim 7, wherein said absorbent material (13) is irreversible and wherein said moisture-storage capacity (11) is detachable.

9. Clothing according to claim 8, wherein said absorbent material (13) is mounted on said lining and wherein said lining is at least partially detachable.

10. Clothing according to claim 7, wherein said absorbent material (13) is reversible and capable of releasing stored moisture.

11. Clothing according to claim 7, wherein said storage capacity (11) is installed in a zone located at a distance from said moisture-production zone.

12. Clothing according to claim 1, wherein said longitudinal moisture-transfer means and said moisture collectors are attached to outer and inner sides of said lining, respectively.

13. Clothing according to claim 1, wherein said moisture collectors have an absorptive capacity less than an absorptive capacity of said longitudinal moisture-transfer means.

14. Clothing according to claim 4, herein said longitudinal moisture-transfer means have an absorptive capacity less than an absorptive capacity of said storage volume (11).

15. Clothing according to claim 1, wherein said material comprises, between said lining (5) and said outer covering 97), an insulating layer (6) having an inner surface covered with a moisture-proof inner covering (8).

16. Glove made of a material according to claim 1.

17. Glove according to claim 14, wherein said longitudinal moisture-transfer means (9) extend longitudinally along fingers of said glove.

18. Glove according to claim 15, wherein said storage capacity (11) is arranged a wrist portion of said glove.

19. Footwear equipped with the material according to claim 1.

20. Glove according to claim 1 and associated with claim 3, wherein the storage capacity (11) is arranged around the wrist.

21. Footwear characterized by the fact that it is equipped with the material according to any of claims 1 to 19.

* * * * *